US006029836A

United States Patent [19]

Ligeras

[11] Patent Number: 6,029,836

[45] Date of Patent: Feb. 29, 2000

[54] WINE CAP

[76] Inventor: Achilles P. Ligeras, 5 Meadow La., New City, N.Y. 10956

[21] Appl. No.: 09/200,806

[22] Filed: Nov. 27, 1998

[51] Int. Cl.[7] ..... B65D 39/00

[52] U.S. Cl. ..... 215/296; 215/356; 81/3.48

[58] Field of Search ..... 215/296, 297, 215/354, 356, 357, 364; 81/3.48

[56] References Cited

U.S. PATENT DOCUMENTS

| | | | |
|---|---|---|---|
| 1,818,626 | 8/1931 | Johnston | 81/3.48 |
| 4,446,673 | 5/1984 | Desthieux | 215/296 X |
| 4,574,662 | 3/1986 | Jones | 81/3.45 |
| 5,495,958 | 3/1996 | Konrad et al. | 215/364 X |

*Primary Examiner*—Stephen K. Cronin
*Attorney, Agent, or Firm*—Stanley J. Yavner

[57] ABSTRACT

A cap device, particularly for a wine bottle, is disclosed as including a cap having a recessed top opening for receiving a screw for threadable insertion into the cork of the wine bottle. The recess at the top of the cap is of basically square shape with two recess extensions for receiving a butter knife, or the like, for turning the cork and screw as a unit and thereby unscrewing the cap, which is threadably attached to the outside of the neck of the wine bottle. The threading direction of the threads of the cap and neck of the wine bottle are opposite to the threading direction between the cork and the screw. Additionally, the cap is structured to extend a distance above the extent of the cork in the neck of the wine bottle, the cork is bullet-shaped and channels are defined transverse to the threads extending outwardly of the neck of the wine bottle, in order to allow the escape of compressed carbon dioxide in a sparkling wine or champagne bottle as the cap is unscrewed and the cork lifted. The top of the screw defines a spherical projection in order to assist guiding the cork in, with respect to the recess of the cap, when reinserting the cork after use.

4 Claims, 2 Drawing Sheets

42
38
38
34
28
46
26
32
30
40
12
13
24'
14

10
18
16
24
22
24
20

38
42
38
28
26
46
32
14

4
38
42
4
34
28

WINE CAP

FIELD OF THE INVENTION

This invention relates primarily to wine bottle caps and more particularly to wine bottle caps for use with wine bottle corks.

BACKGROUND OF THE INVENTION

Primarily, there are two types of wine. The first type of wine is not "carbonated" (not containing a charge of carbon dioxide). The second type of wine is naturally or otherwise charged with carbon dioxide and therefore includes throughout tiny bubbles of carbon dioxide. A common example of the latter type is usually referred to as sparkling wine.

In either of the types of wine, those with carbon dioxide and those not, a cork is usually used to cap the bottle, but then, usually, the only way to remove the cork for use is by use of a corkscrew, which is sometimes not readily available. Also, in either case, if only a partial bottle of wine is consumed and the user wishes to replace the cork for a later and further use, the reinsertion of the cork properly is not possible.

In addressing the first of the above-mentioned problems, there has been substantially no development respecting the cork structure, which would enable removal of the cork without a corkscrew. With respect to the problem involving the replacement of the cork for later and further use of the partially consumed wine, there has been substantially no development which has properly addressed this problem.

Additionally, there has been a problem particularly with sparkling wines that relates to the "explosion" of the cork, possibly leading to injury of the consumer, when the cork is removed from the neck of the wine bottle.

OBJECTS AND SUMMARY OF THE INVENTION

Accordingly, a primary object of the present invention is to provide a structure for capping a wine bottle which enables removal of the capping structure without the use of a corkscrew.

A further and more particular object is to provide a structure, including a cork, for capping a wine bottle which includes removal thereof without the use of a corkscrew.

A still further object of the present invention is to provide a structure, including a cork, for capping a wine bottle, which enables the recapping thereof when only part of the wine in the wine bottle is consumed.

A still further and more particular object of the present invention is to provide a structure, including a cork, for capping a wine bottle, and which cork is shaped so as to enable easy reinsertion thereof to a partially consumed wine bottle, and to enable slow release of the carbon dioxide.

These and other objects of the present invention are provided in a structure for capping a wine bottle which features a cap structure for use with a wine bottle, the outside neck of which has protruding threads. The cap structure has a cap with a recessed top opening defined by the cap top, for receiving a recessed screw for threadable insertion to a cork. The recess is designed, in basically solid square or rectangular shape, with two recess extensions for receiving a knife or the like, inserted for turning the cap and cork, to thereby unscrew the skirt of the cap, having internal threads, from the threads on the neck of the bottle. The bottom portion of the cork is made generally bullet-shaped, terminating in a lower point, to enable ease of reinsertion and to assist in preventing the threat of an explosion when the cork is first removed from a sparkling wine bottle. In this regard, as the cap is turned during first removal, and thereby the cork lifted, the charge of carbon dioxide is allowed to slowly escape up along the bullet-shaped bottom of the cork, over the lip of the bottle neck, and then through thread channels and under the skirt of the cap to prevent the explosion.

BRIEF DESCRIPTION OF THE DRAWINGS

Other objects, features and advantages of the present invention will become apparent by reference to the following detailed description of the preferred, but nonetheless illustrative, embodiment of the present invention, with reference to the accompanying drawings wherein.

DETAILED DESCRIPTION OF A PREFERRED EMBODIMENT

Figure 1:
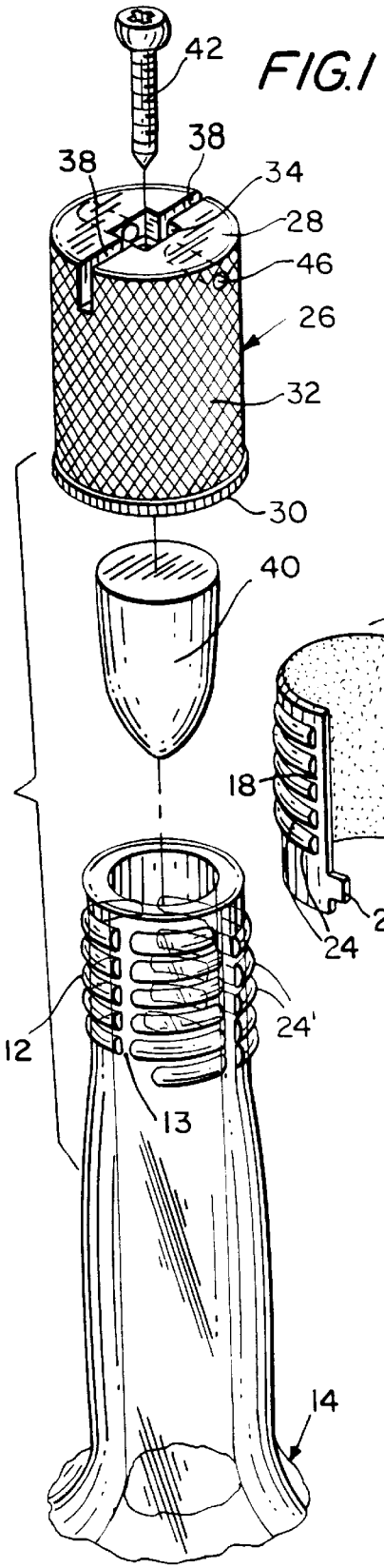
FIG. 1 is a front and top isometric, exploded view of the neck of the wine bottle with which the present invention is useful, the cork for insertion therein, and the cap and screw for attachment to the cork, so that the cap and cork are movable, with respect to the bottle, as a unitary structure.
Figure 1A:
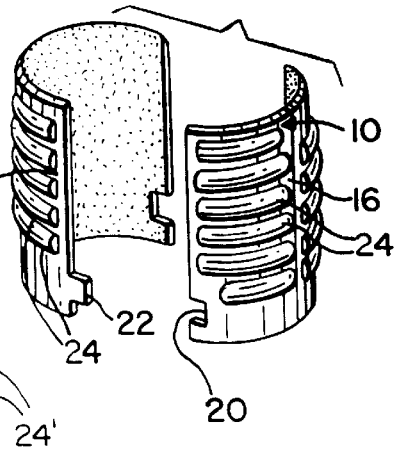
FIG. 1A is an alternative neck thread structure, useful with the present invention to provide outside threads when the neck of the bottle has none.
Figure 2:
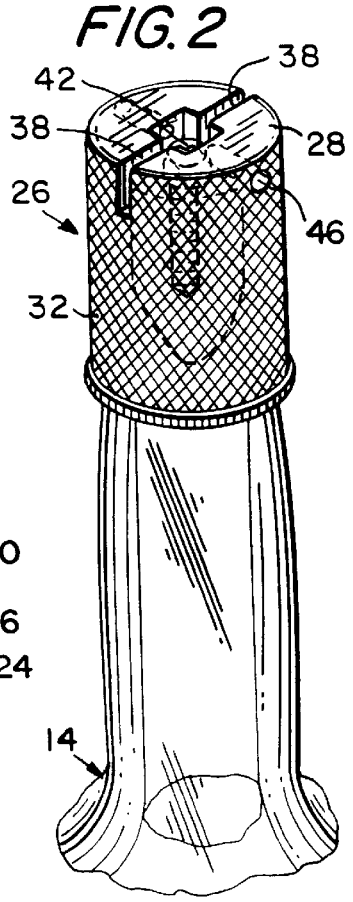
FIG. 2 is a view similar to that of FIG. 1, but with the cap, cork and screw connected, and in place with respect to sealing the top opening of the neck of a wine bottle.
Figure 3:
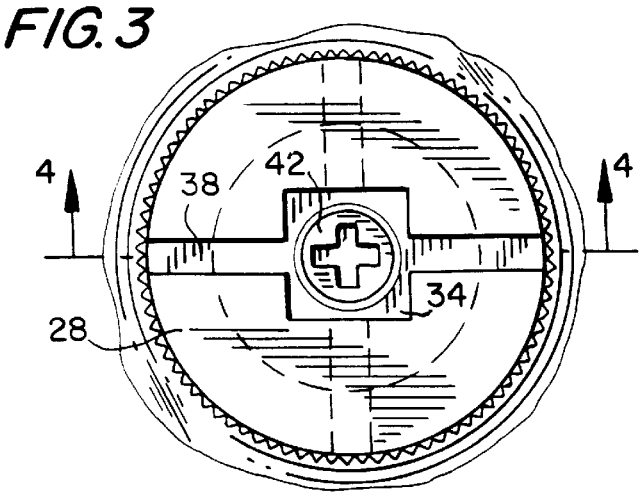
FIG. 3 is a top view of the structure of FIG. 2.

Referring to the drawings, FIG. 1A shows a cap mating device 10 for positioning on the outside of the neck portion 12 of the wine bottle, generally designated 14.

In many instances, particularly when dealing with a wine bottle structure in the usual manner, currently and in the past, the neck of the wine bottle does not expose and define threads on the outside of the neck of the bottle 14. Accordingly the cap mating device 10, in those instances, conveniently provides the exposed threads for purpose of this invention. Cap mating device 10 includes plastic, half-cylinder parts 16, 18 which are snapped together conveniently by means of recess 20 and mating tab 22 of such cap mating device 10. When the two half-cylinder parts 16, 18 are placed over the bottle neck, and snapped together, continuous threads 24 are formed (but with channels, as hereinafter described) for use in accordance with the invention, as described. For securing parts 16, 18 to the bottle neck, the insides thereof have two-sided adhesive tape or an exposed adhesive, protected until use by a suitable, removable paper or plastic cover, or the like.

Alternatively, the neck 12 of the wine bottle itself has projecting threads 24', for enabling use of the present invention, as will be hereinafter described, without the necessity of the cap mating device depicted in FIG. 1A thereof. As shown in the exploded view of FIG. 1, the present invention includes a cap, generally designated 26 having a closed top 28 and an open bottom 30, as well as a side skirt 32. Side skirt 32 is knurled for easy gripping, and for convenient turning of cap 26 when lifting the cap from the bottle 14. The top of cap 26 defines a generally cubic recess 34, and side recess extensions 38. The shape of recess 34 enables a socket tool, or the like, to be inserted for manipulating screw 42, or the like, to secure cap 26 to cork 40. The side recess 34 extensions extend from the cubic recess 34 to the outermost extents of the top 28 of cap 26, thus enabling the use of a butter knife, or the like to unscrew cap 26 and a bullet-shaped cork 40 from bottle 14. In other words, a butter knife, which is commonly available and easily accessible in the kitchen, is inserted to recess extensions 38, crossing through cubic recess 34 in order to turn cap 26 in a counter-clockwise direction, for example. Conversely, hemispherical head screw 42 is screwed into cork 40 through cubic recess 34 in a counter-clockwise direction, so that its removal is in a clockwise direction. In this manner, the unscrewing of cap 26 from bottle 14, with the head of screw 42 resting on the lip 44 at the bottom of recess 34, will not impair the tight connection between screw 42 and cork 40. In other words, cork 40 is removed from bottle neck 12 as cap 26 is unscrewed therefrom.

Alternative methods of removal of cap 26 and cork 40, together, are presented by this invention; firstly, is the method previously described, whereby a butter knife is used to unscrew cap 26 by placement of such knife into recess extensions 38; secondly, a through hole 46 is defined by cap 26, whereby a common ballpoint pen, for example, is inserted, and then used to turn cap 26 in a counter-clockwise direction, when viewing cap 26 from the top thereof; and, thirdly, the knurled surface of cap 26 is a convenient handle for turning cap 26 in a counter-clockwise direction, without the use of the knife or pen as previously described.

By way of further description of the details of the present invention, it should be mentioned that the hemispherical head of screw 42 is intended to assist, and in fact does assist, in the proper relationship being established between the cork 40 and the vertical axis of screw 42. When screwing in screw 42 to cork 40, it is essential for proper operation that the screw shank be as close to vertical with respect to cork 40 as can be accomplished.

Figure 4:
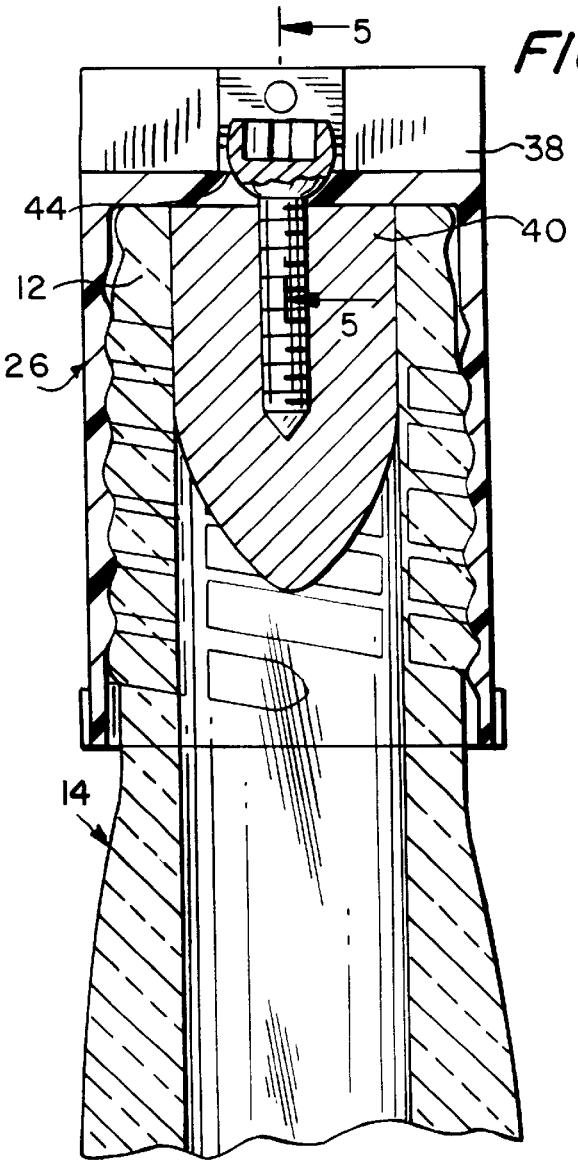
FIG. 4 is a sectional view, taken along the line 4—4 of FIG. 3, and showing the sealing position of the cap, screw and cork on the neck of a wine bottle.
Figure 5:
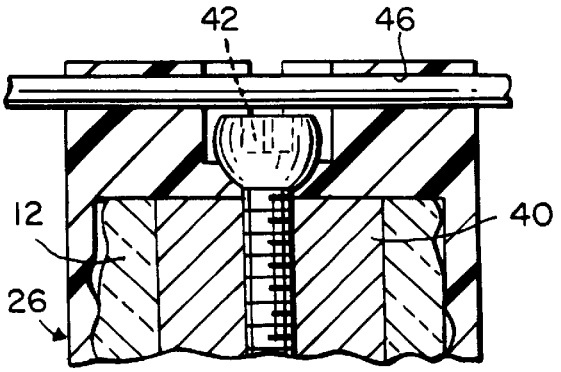
FIG. 5 is a sectional view, taken along the line 5—5 of FIG. 4 and showing particularly a transverse insertion opening for inserting a pencil, pen or screwdriver to assist in opening a wine bottle.
Figure 6:
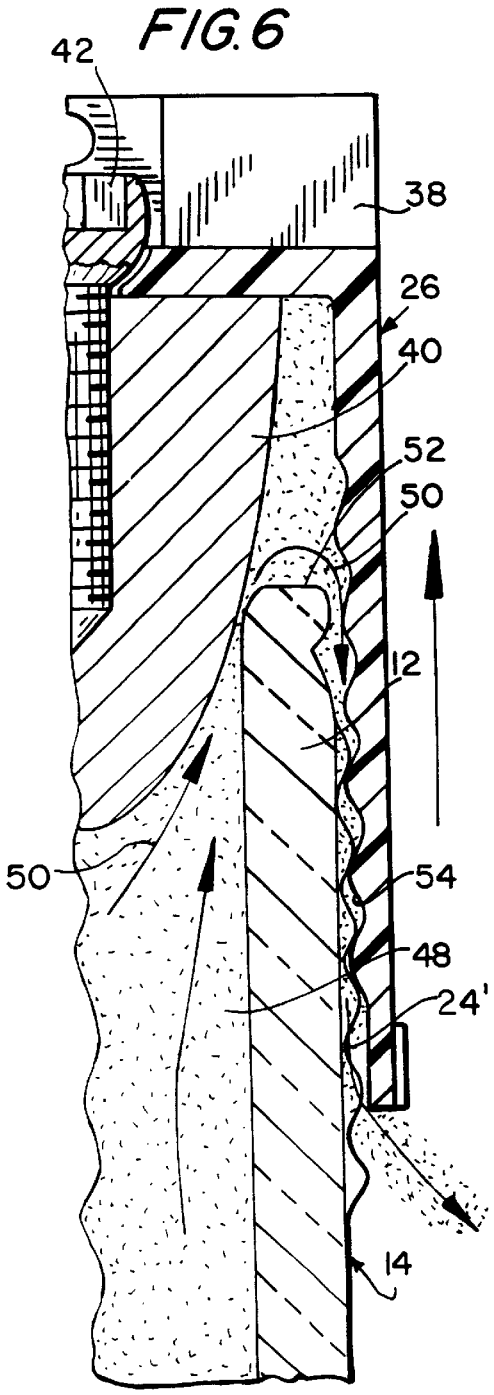
FIG. 6 is a view similar to that of FIG. 4, but showing the cap, screw and cork in an upwardly moving position, with respect to the neck of a wine bottle, thereby to allow slow venting of the gas pressure in a sparkling wine bottle, in order to prevent the explosion thereof.

Referring particularly to FIGS. 4 and 6, the cap of the present invention is shown in FIG. 4, as well as FIG. 5, in a tightly closed position with respect to bottle neck 12. FIG. 6 shows a carbonated wine 48 in bottle 14, with cap 26 partially lifted with respect thereto. It may be seen that the carbon dioxide in the wine is allowed to slowly escape in the direction of arrows 50 by the cork, over the upper lip 52 of bottle neck 12 and past mating threads 24' on bottle neck 12, and threads 54 on the inside of skirt 32 of cap 26. More particularly, channels 13 as defined by threads 24' (FIG. 1) are used to provide a break in the threads 24' projecting outwardly from the neck of the bottle, or threads 24 projecting outwardly from plastic parts 16, 18 overlaying bottle neck 12. Therefore, the flow of carbon dioxide bubbles in direction 50, past thread 24', as shown in FIG. 6 is actually a flow through such channels 13. In this manner, the invention is used to prevent an explosion of cork 40 from bottle 14 during the removal thereof from a carbonated beverage wine bottle.

The invention has been described herein with respect to all of its features, but the present invention should be limited, only by the following claims:

What is claimed is:

1. A cork removal and replacement apparatus for use with a wine bottle having a cork defining a top surface and a bottle neck, said bottle for containing wine, and wherein protruding threads extend outwardly from said neck, said threads providing a first direction enabling removal of said cork from said wine bottle and a second direction for replacing said cork after use of said wine, comprising:

(a) a cap having a top with an edge, and a skirt, and defining a bottom opening, and internally directed threads projecting from the inside of said skirt;

(b) said top defining a centrally located recess having recess walls, with recess extensions extending radially, outwardly and in line from said central recess to the edge of said top;

(c) said central recess having a bottom wall with an opening therein; and (d) a hemispheric-headed screw for extending through said bottom wall opening into said cork, said screw having threads for providing a screw direction, which is opposite to said first direction and which enables removal of said screw from said cork.

2. A cork removal and replacement apparatus according to claim 1, wherein said bottom wall rests upon, and is parallel with the top of said cork, and wherein the depth of said central recess is at least one-half inch, said skirts and recess walls defining openings providing a through-hole from one side of the skirt to the other, said through-hole providing an opening for insertion of an element to provide leverage for turning said cap inside first direction.

3. The invention according to claim 1, wherein said cork is bullet-shaped.

4. The invention according to claim 1, wherein said cork removal and replacement apparatus includes a cap-mating device for encircling said neck to provide threads extending outwardly from said neck for mating with said internally directed threads, said cap mating device having mating parts, with means for snapping them together.

* * * * *